United States Patent [19]

Arakaki

[11] Patent Number: 4,828,421

[45] Date of Patent: May 9, 1989

[54] PERSONALIZED LOOSE-LEAF ALBUM COVER

[76] Inventor: Clifford S. Arakaki, 503 Woodbury Dr., Clarksville, Tenn. 37040

[21] Appl. No.: 191,228

[22] Filed: May 6, 1988

[51] Int. Cl.[4] ..... B42F 13/16; B42F 13/40

[52] U.S. Cl. ..... 403/3; 281/29; 402/80 R

[58] Field of Search ..... 281/15 R, 29 R; 402/3, 402/72, 3, 4, 19, 70, 71, 72, 80 R

[56] References Cited

U.S. PATENT DOCUMENTS

| | | | |
|---|---|---|---|
| 38,189 | 9/1888 | Kinnard . | |
| 170,042 | 11/1875 | Anthony . | |
| 230,256 | 7/1880 | Emerson . | |
| 1,826,259 | 10/1931 | Schade . | |
| 2,302,410 | 11/1942 | Bannon | 402/4 X |
| 3,301,621 | 1/1967 | Stephenson | 312/234 |
| 4,140,565 | 2/1979 | Parker et al. | 156/219 |
| 4,172,332 | 10/1979 | Holes et al. | 402/3 X |
| 4,315,642 | 2/1982 | Errichiello | 402/3 X |
| 4,466,638 | 8/1984 | Miskin | 402/4 X |
| 4,515,493 | 5/1985 | Radovich | 402/72 X |
| 4,601,489 | 7/1986 | Stancate | 281/21 R |

FOREIGN PATENT DOCUMENTS

| | | | |
|---|---|---|---|
| 680215 | 8/1939 | Fed. Rep. of Germany | 402/3 |
| 1215736 | 4/1960 | France | 402/70 |
| 6610649 | 2/1967 | Netherlands | 402/3 |
| 2045171 | 10/1980 | United Kingdom | 402/72 |

*Primary Examiner*—Paul A. Bell

*Attorney, Agent, or Firm*—Stephen T. Belsheim

[57] ABSTRACT

A loose-leaf personalized album comprising a top cover having an exterior surface and an interior surface. The top cover contains a recess in the exterior surface thereof. A personal indicia is positioned within the recess so as to permanently maintain the personal indicia in position in the recess whereby said personal indicia is visible. A bottom cover has an exterior surface and an interior surface. The bottom cover contains a recess within the interior surface thereof for receipt of a second personal indicia. The album i includes a means for maintaining the second personal indicia within said recess. A plurality of feet project from the exterior surface of the bottom cover. A ring assembly is affixed to the interior surface of the bottom cover. A spine has an interior surface an an exterior surface. The spine is hingedly connected to the top and bottom covers.

9 Claims, 2 Drawing Sheets

10
12
14
18
28
30
32
34
36
38
40
44
46
50
52
54
56
60
62
64
68
70
72
20
22
24

PERSONALIZED LOOSE-LEAF ALBUM COVER

BACKGROUND OF THE INVENTION

The invention is directed to a cover for an album, and more specifically, the invention is directed to a personalized loose-leaf album cover.

Album covers and related products have been known before. For example, U.S. Pat. No. 170,042 to Anthony shows a photograph album. U.S. Pat. No. 3,301,621 shows a transparent container for books, magazines and the like. U.S. Pat. No. 1,826,259 shows a book cover made from wood.

Devices to be used with books have been known before. For example, U.S. Pat. No. 389,891 to Kinnard shows an adjustable book leveler.

Often times a person wants a loose-leaf album cover that is permanently personalized. However, none of the above-mentioned patents show album covers which are permanently personalized.

Sometimes a person would like a personalized album cover that is permanently personalized on the exterior thereof wherein the personalization of the interior surfaces of the album can be temporary or permanent. None of these earlier patents show a personalized loose-leaf album cover which includes means on the interior surface of the album covers to either permanently or temporarily personalize the album cover.

Thus, there exists a need for a personalized loose-leaf album cover. There exists a further need for a personalized loose-leaf album cover that provides means for personalizing the interior surfaces thereof, either permanently or temporarily.

SUMMARY OF THE INVENTION

It is thus a primary object of the invention to provide a permanently personalized loose-leaf album cover.

It is another object of the invention to provide a permanently personalized loose-leaf album cover that includes means to personalize, either permanently or temporarily, the interior surfaces thereof.

In one form thereof, the invention is a personalized loose-leaf album cover comprising a top cover which has an exterior surface and an interior surface. The top cover contains a recess in the exterior surface thereof. A personal indicia is positioned within the recess so as to permanently maintain the personal indicia in position in the recess whereby said personal indicia is visible. A bottom cover which has an exterior surface and an interior surface. The bottom cover contains a recess within the interior surface thereof for receipt of a second personal indicia. A means for maintaining said second personal indicia within said recess. A plurality of feet project from the exterior surface of the bottom cover. A ring assembly is affixed to the interior surface of the bottom cover. A spine has an interior surface and an exterior surface. The spine is hingedly connected to the top and bottom covers.

BRIEF DESCRIPTION OF THE DRAWINGS

The above-mentioned and other features and objects of the invention, and the manner of attaining them, will become more apparent and the invention itself will be better understood by reference to the following description of specific embodiments of the invention taken in conjunction with the accompanying drawings, wherein.

DETAILED DESCRIPTION OF SPECIFIC EMBODIMENTS

Figures 1, 2:
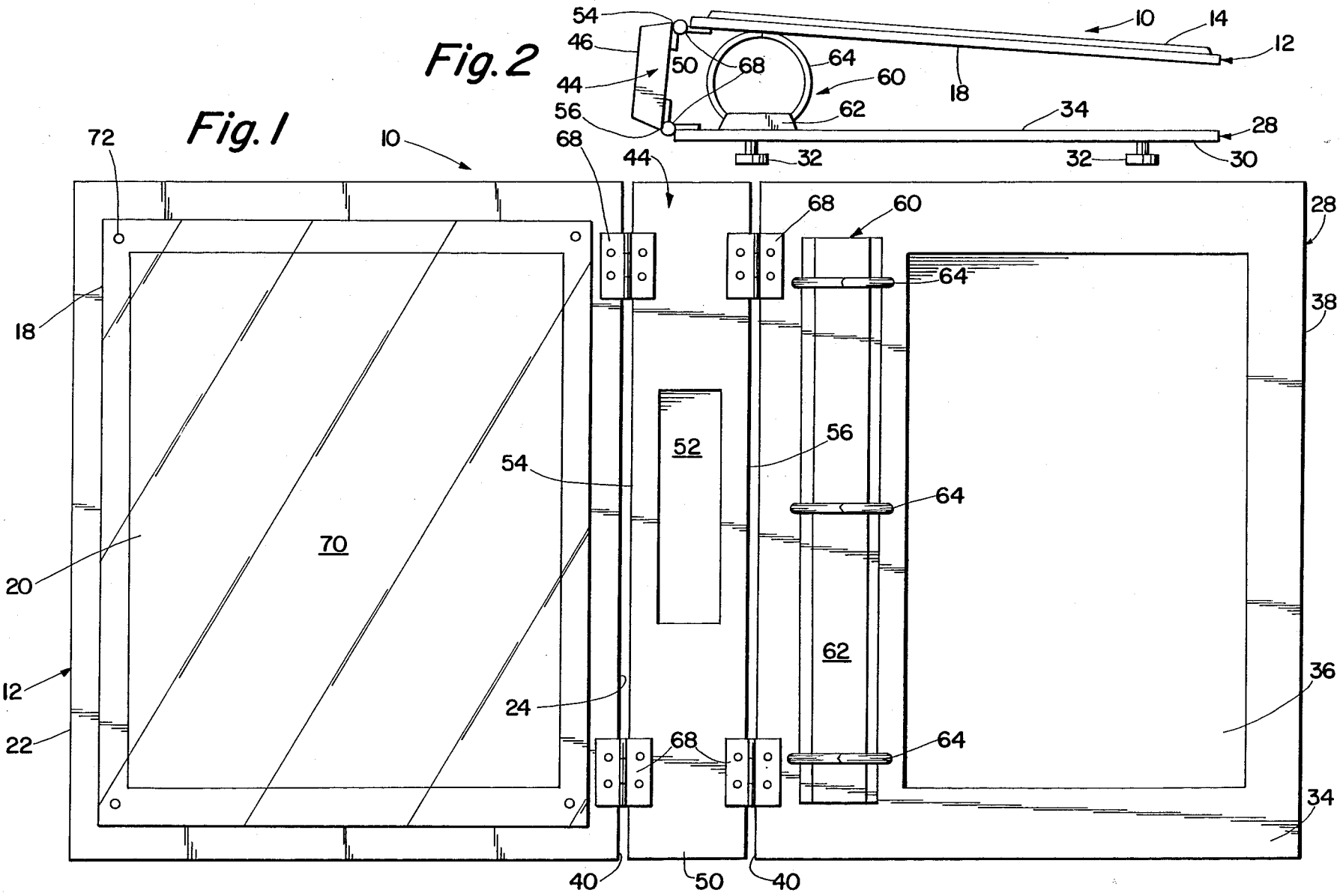
FIG. 1 is a top plan view of the interior surfaces of the specific embodiment of FIG. 1, but in an open condition.
FIG. 2 is a side plan view of a specific embodiment of the invention in a folded condition.
Figure 4:
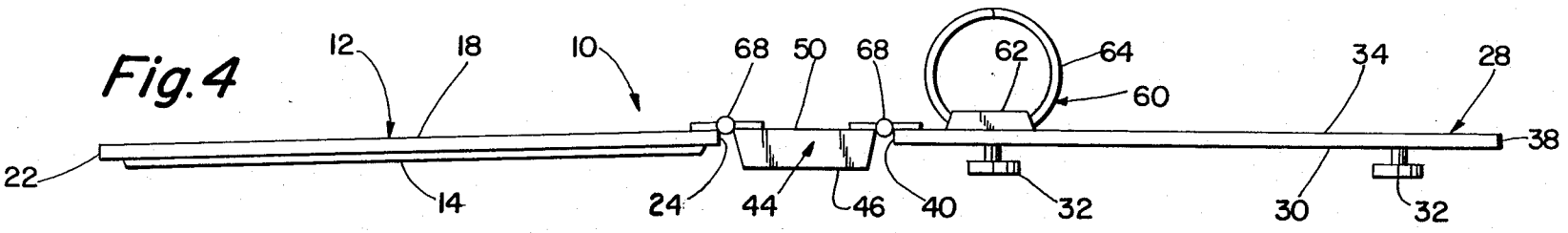
FIG. 4 is a side view of another specific embodiment of the invention in an open condition.

Referring to the drawings, there is illustrated a specific embodiment of the personalized loose-leaf album cover of the invention generally referred to as 10. Album cover 10 includes a top cover 12 . Top cover 12 has an exterior surface 14 which has contained therein a recessed portion 16, and an interior surface 18 which has contained therein a recessed portion 20. Top cover 12 has opposite side edges 22 and 24.

Referring to recessed portion 16, a plurality of personal indicia generally designated as 26 are positioned therein. In this embodiment these indicia 26 are military insignia. However, many other types of personal indicia can be positioned with recessed portion 66.

Indicia 26 are permanently positioned and held within recessed portion 16 by a hardened polymer resin. The polymer resin is poured into the recessed portion 16 and is allowed to harden. The result is that the indicia 26 are permanently bonded to the exterior surface 14 of the top cover 12. It is contemplated that other ways to permanently affix these personal indicia exist and are practical to use with the invention. However, the use of a polymer resin is the preferred way known at this time.

Referring to recessed portion 20 of interior surface 18, a second personal indicia (not illustrated) may be positioned within recessed portion 20. This second personal indicia may comprise a photograph, a certificate, a diploma or other memorabilia.

The specific embodiment illustrated in FIG. 1 shows a transparent cover 70 covering recessed portion 20. Transparent cover 70 is detachably affixed to the interior surface 18 by a plurality of fasteners 72. Transparent cover 70 protects any personal indicia contained within recessed portion 20 from damage, as well as maintaining said indicia within the recessed portion 20.

It is contemplated that the transparent cover 70 is best used with flat materials such as a photograph. In this regard, the photograph can be of a size so that the peripheral edges thereof are sandwiched between the cover 70 and the interior surface 18 of the top cover.

It should be mentioned that in the alternative, a polymer resin may be poured in recessed portion 20 so as to permanently bond indicia to the top cover 12. The personal indicia may be glued within recessed portion 20 so as to be affixed therein. Transparent cover 70 thus protects the indicia from damage.

Album cover 10 also includes a bottom cover 28. Bottom cover 28 has an exterior surface 30 which has a plurality of feet 32 depending therefrom, and an interior surface 34 which has contained therein a recessed portion 36. Bottom cover 28 has opposite edges 38 and 40. The peripheral edge (which includes side edges 38,40) is illustrated as being flat. However, it is contemplated that this peripheral edge can be contoured. For example, this peripheral edge may be plateaued or stepped.

Referring to the feet 32, these feet 32 may be of a distinctive shape and appearance; for example, feet 32 may be claw-style feet made of brass. Feet 32 provide the album cover 10 with the ability to be displayed. For example, the album cover 10 having feet 32 can be openly displayed in a fashion similar to that of a piece of furniture. The display of the album cover on a stand, table or the like will not detract from the elegant appearance of the furniture. The bottom surface of the feet 32 may have felt or the like affixed thereto to prevent the furniture on which the album cover is displayed from being damaged.

Referring to FIG. 1, recessed portion 36 may contain another personal indicia in a like fashion to recessed portion 20. A transparent plate, solidified polymer resin, or the combination of a glue and cover may be used to protect and maintain the indicia within recessed portion 36.

Album cover 10 further includes a spine 44. Spine 44 includes an exterior surface 46 which has contained therein a recessed portion 48, and an interior surface 50 which has contained therein a recessed portion 52. Spine 44 has opposite side edges 56 and 58.

Figure 3:
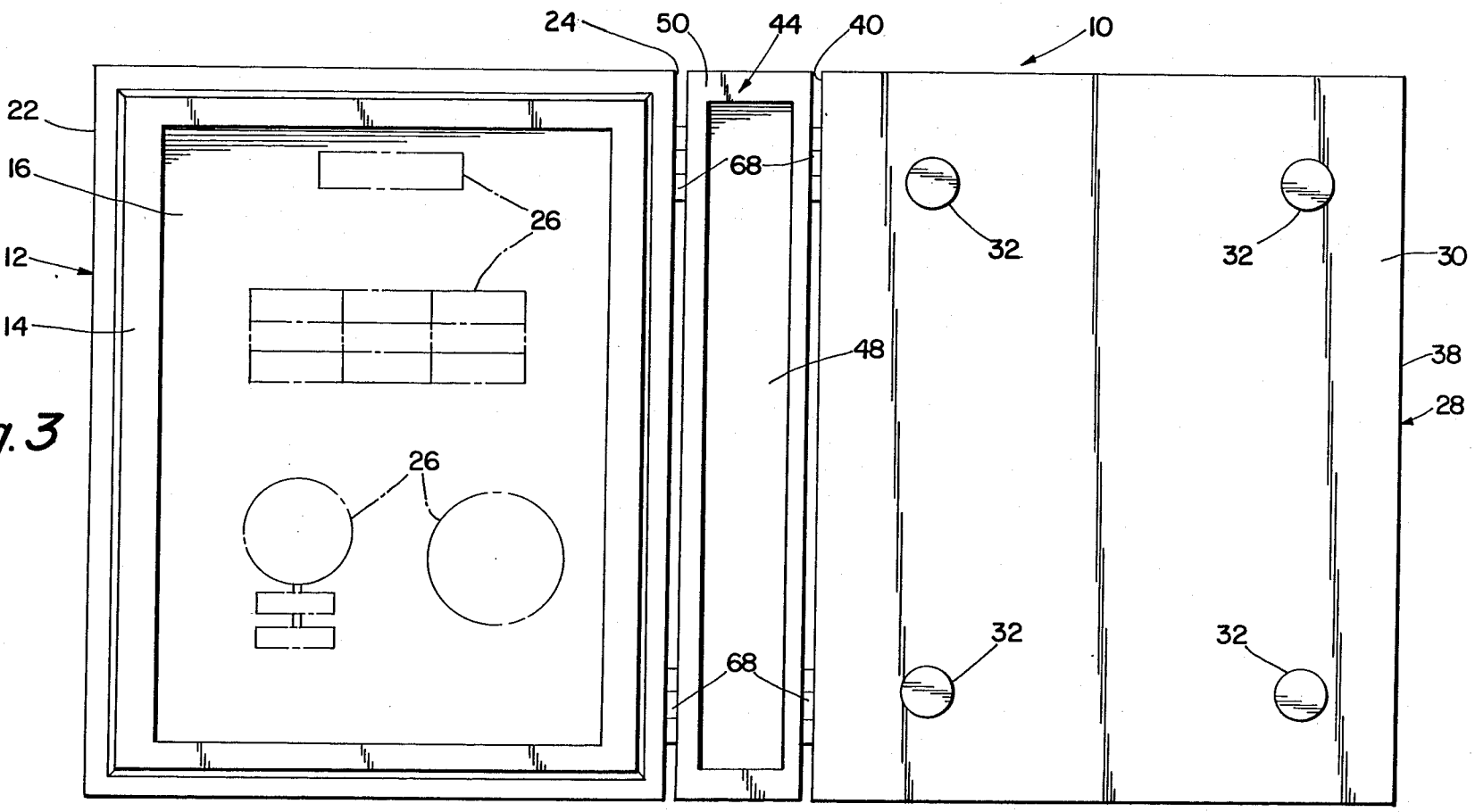
FIG. 3 is a top plan view of the exterior surfaces of the specific embodiment of FIG. 1, but in an open condition.

Referring to FIG. 3, recessed portion 48 may contain personal indicia. Typically, a polymer resin is poured into recessed portion 48. This polymer resin protects and maintains the indicia within recessed portion 48. However, it should be appreciated that a transparent cover could be affixed over recessed portion 48.

Recessed portion 52 in the interior surface 50 of the spine 44 may also contain personal indicia. A transparent cover or a polymer resin may be used to protect and maintain the indicia within recessed portion 52.

It should be appreciated that the use of a polymer permanently bonds the indicia to the album cover. The use of a transparent cover can provide a temporary means to protect and maintain the indicia within the recessed portion 52.

A ring binder assembly 60 is affixed to the interior surface 34 of the bottom cover 28. Ring binder assembly 60 is comprised of a base 62 and three rings 64.

A plurality of hinges 68 hingedly connect the spine 44 to the top cover 12 and the bottom cover 28.

Overall, it becomes apparent that applicant has invented a new and useful album cover. More specifically, the album cover is a personalized loose-leaf album cover.

By virtue of a recessed portion contained in the exterior surface of the top cover, the album is permanently personalized. The polymer resin permanently protects the indicia and maintains the indicia in position within the recessed portion.

The remainder of the recessed portions provide means to display personal indicia in either a temporary or permanent fashion.

Throughout the above description the indicia which have been referred to have been personal indicia separate and distinct from the wooden album covers themselves. For example, these indicia may include military insignia or the like. However, it is contemplated that personalized indicia, such as initials, last names, family crests and the like, can be carved into the recessed portion of the covers.

While this invention has been described as having preferred embodiments, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A personalized loose-leaf album comprising:

a top cover having an exterior surface and an interior surface, said top cover containing a recess in the exterior surface thereof, a personal indicia positioned within said recess so as to permanently maintain said personal indicia in position in said recess whereby said personal indicia is visible;

a bottom cover having an exterior surface and an interior surface, said bottom cover containing a recess within the interior surface thereof for receipt of a second personal indicia, a means for maintaining said second personal indicia within said recess, and a plurality of feet projecting from said exterior surface of said bottom cover;

a ring assembly affixed to said interior surface of said bottom cover; and a spine having an interior surface and an exterior surface; said spine being hingedly connected to said top and bottom covers.

2. The personalized loose-leaf album according to claim 1 wherein said top cover is made of wood and said bottom cover is made of wood.

3. The personalized loose-leaf album according to claim 1 wherein said feet are made of brass and each one of said feet presents a bottom surface.

4. The personalized loose-leaf album according to claim 3 wherein a soft material is affixed to the bottom surface of each one of said feet.

5. The personalized loose-leaf album according to claim 1 wherein said personal indicia positioned within said recess in the exterior surface of said top cover comprises a military insignia.

6. The personalized loose-leaf album according to claim 1 wherein said means for maintaining said second personal indicia within said recess comprises a transparent cover.

7. The personalized loose-leaf album according to claim 6 wherein said second personal indicia comprises a photograph.

8. The personalized loose-leaf album according to claim 1 further comprising a first set of hinges connecting said spine to said top cover and a second set of hinges connecting said spine to said bottom cover.

9. A personalized loose-leaf album comprising: a top cover having an exterior surface and an interior surface, said top cover containing a recess in the exterior surface thereof, a separate personal indicia positioned within said recess, a layer of hardened polymer resin within said recess so as to permanently bond said personal indicia in said recess whereby said personal indicia is visible;

a bottom cover having an exterior surface and an interior surface, said bottom cover containing a recess within the interior surface thereof for receipt of a second personal indicia, a transparent plate affixed over said recess in said bottom cover so as to maintain said second personal indicia within said recess, and a plurality of decorative feet projecting from said exterior surface of said bottom cover;

a ring assembly affixed to said interior surface of said bottom cover; and a wooden spine having an interior surface and an exterior surface a set of hinges hingedly connected said spine to said top and bottom covers.

* * * * *